US007548249B2

(12) United States Patent
Tsai et al.

(10) Patent No.: US 7,548,249 B2
(45) Date of Patent: Jun. 16, 2009

(54) METHOD AND APPARATUS OF DYNAMIC FRAME PRESENTATION IMPROVEMENT FOR LIQUID CRYSTAL DISPLAY

(75) Inventors: Chung-Kuang Tsai, Hsinchu Hsien (TW); Li-Ru Lyu, Hsinchu Hsien (TW); Hung-Min Shih, Changhua Hsien (TW); Yung-Zhi Wu, Kaohsiung (TW); Ya-Fang Chen, Taichung Hsien (TW)

(73) Assignee: Au Optronics Corp., Hsinchu (TW)

( * ) Notice: Subject to any disclaimer, the term of this patent is extended or adjusted under 35 U.S.C. 154(b) by 675 days.

(21) Appl. No.: 10/915,397

(22) Filed: Aug. 11, 2004

(65) Prior Publication Data

US 2005/0253876 A1 Nov. 17, 2005

(30) Foreign Application Priority Data

May 11, 2004 (TW) ..... 93113159 A

(51) Int. Cl.
*G09G 3/36* (2006.01)

(52) U.S. Cl. ..... 345/690; 345/89

(58) Field of Classification Search ..... 345/98, 345/690, 100, 89, 99, 204; 348/254, 671; 358/2.1, 3.01, 3.13
See application file for complete search history.

(56) References Cited

U.S. PATENT DOCUMENTS

| | | | | |
|---|---|---|---|---|
| 5,083,210 | A * | 1/1992 | Reilly et al. | 358/3.08 |
| 6,198,469 | B1 * | 3/2001 | Tjandrasuwita | 345/690 |
| 6,897,842 | B2 * | 5/2005 | Gu | 345/90 |
| 7,068,253 | B2 * | 6/2006 | Kudo et al. | 345/99 |
| 7,119,772 | B2 * | 10/2006 | Amundson et al. | 345/87 |
| 7,221,347 | B2 * | 5/2007 | Lee et al. | 345/89 |
| 7,403,183 | B2 * | 7/2008 | Someya | 345/98 |

FOREIGN PATENT DOCUMENTS

| | | |
|---|---|---|
| JP | 04-365094 | 12/1992 |
| JP | 06-189232 | 7/1994 |
| JP | 2002-062850 | 2/2002 |

* cited by examiner

*Primary Examiner*—Abbas I Abdulselam
(74) *Attorney, Agent, or Firm*—Thomas, Kayden, Horstemeyer & Risley

(57) ABSTRACT

A method of dynamic frame presentation improvement for liquid crystal display is disclosed. The method comprises the step of providing a gray level mapping table, which maps the signal gray levels from 0 to N into mapped gray levels from 1 to N−1 level. Thereafter, the mapped data is fed into over-voltage compensation circuit. The over-voltage compensation circuit then implements process of the gray level ascending or gray level descending while the previous frame turns into current frame with a varied gray level.

9 Claims, 3 Drawing Sheets

METHOD AND APPARATUS OF DYNAMIC FRAME PRESENTATION IMPROVEMENT FOR LIQUID CRYSTAL DISPLAY

FIELD OF THE INVENTION

The present invention relates to process signal gray levels for liquid crystal display (LCD), specifically, to a method and apparatus by means of a mapping table associated with an over-voltage compensation technique to improve dynamic frame representation of signal gray levels before the signal feeds into the driver of a LCD.

BACKGROUND OF THE INVENTION

The fundamental structure of the LCD includes two pieces of transparent glasses (for transmitting LCD type) or a piece of transparent glass and with an non transparent substrate (for reflective LCD type) encapsulated with a thin film of liquid crystals. The liquid crystals are molecule having a property of either twisted nematic structure or helix nematic structure. The liquid crystal molecule having polarization and hence a numerous of liquid crystal molecules can rearrangement to a vertical or twisted an specific angle or lies on or parallel to the glass substrate in accordance with the intensity of the electric field results in the backside light source can transmit or partial transmit, i.e. gray level.

Generally, to prevent liquid crystal molecules from dissociate, after a positive voltage exerts to the liquid crystal molecules during a positive frame time, another negative voltage during a negative frame time is followed. A typical time period of a picture frame is about 16.7 ms, which is determined in accordance with the visual transit preserving time of human. The response time of the LCD determined the quality of the dynamic presentation e.g. the occurrence of time retarded while displaying an animating picture. The response time or say response rate is however, determined by the twist rate of the liquid crystal molecular when the electric field is varied. The voltage determines the intensity of the electric field. As analog voltages in a range of maximum to minimum (ground) are converted to digital voltages and express by 8 bit code, the gray levels will be distributed from a range of 255 (totally white) to 0 (totally black). Please refer to FIG. 1A, which shows a schematic diagram of utilizing an over-voltage compensating technique to speed the twist rate of the liquid crystal molecular. Assuming a pixel of a display with gray levels varies with time from the frame 1 to frame 5 being 30, 130, 130, 30, and 30. After over-voltage compensation, the gray levels of the frames will become 30, 130+a, 130, 30−b, and 30, where a, b, are positive compensating values in accordance with prior art.

The technique is illustrated as follows: from frame 1 to frame 2, the gray level increases, and thus a value "a" is added to speed the twist rate of the molecular. From frame 2 to frame 3, the gray level is the same, no compensating is required. The gray level of the current frame 3 is thus still at 130. From frame 3 to frame 4, the gray level deceases, and thus the gray level of the current frame 4 will minus a value of "b" levels as compensation. Finally, from frame 4 to frame 5, the gray level does not change, and thus the frame 5 does not need to be compensated. The corresponding voltages versus gray levels of each frame is shown in FIG. 1B, Accordingly, when the gray level of the previous frame to current frame is at extreme value, either totally white (gray level 255) or totally black (gray level 0), it however, can not add or minus any value. Please refer to the example shown in FIG. 2A, the gray levels of a pixel varies from frame 1 to frame 5 are sequence0: 0, N, N, 0, and 0, respectively. No any value of compensation can be made according to aforementioned technique. The reason is trivial. For example, the gray level of frame 2 is higher than previous frame, however, the gray level already attained to a maximum value N. The frame 3 varied to frame 4 has a similar situation. The gray level decreased but the gray level 0 is the minimum value. It can't decrease any positive value to gray 0 as a compensation request. In FIG. 1B, Vd denotes the voltage of data line of the LCD.

FIG. 3 shows hardware function blocks according to a conventional over-voltage compensation technique. In figure, the signal 105 is fed into over-voltage process circuit 20 in accordance with the forgoing rule depicted on previous paragraphs [0003] to [0005]. The resulted signal 110 is then inputted to data line 30 of the LCD's driving circuit.

Forgoing prior art, over-voltage process circuit 20, though solves the most portions of animating picture retarded issues, however, it can not proceed the voltage compensation for those cases of gray levels of frame to frame varied but the gray levels of the current frame are at two extreme value. An object of the present invention is thus to resolve the forgoing drawbacks.

SUMMARY OF THE INVENTION

A method of dynamic frame presentation improvement for liquid crystal display is disclosed. The method comprises the step of providing a gray level mapping table, which maps the signal gray levels from 0 to N−1 into mapped gray levels from 1 to N−1 level. Thereafter, the mapped data is fed into over-voltage compensation circuit. The over-voltage compensation circuit then implements process of the gray level ascending or gray level descending while the previous frame turns into current frame with a varied gray level.

Preferably, if a mapped gray level of a pixel at previous frame turning into the current frame increase, positive over-voltage compensation is made. On the contrary, negative over-voltage compensation is done.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

As forgoing description in the background of the invention, to speed the twist rate of molecular orientation so as to improve dynamic picture presentation problem, the gray level of the current frame should not be at an extreme value e.g. totally white or black because the over-voltage compensation will be inefficient. The present invention can overcome such problem. The detailed descriptions of the method are as follows.

Figure 1A:
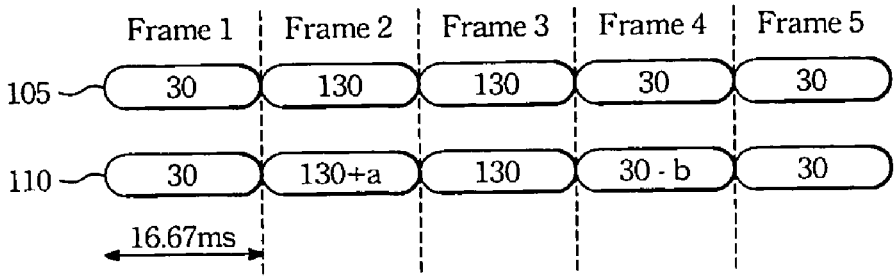
FIG. 1A (Prior Art)
FIGS. 1A and 1B show a technique of over-voltage compensation in accordance with prior art.
Figure 1B:
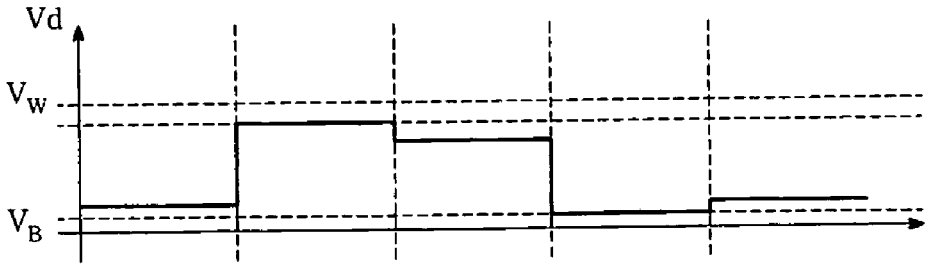
FIG. 1B (Prior Art)
Figure 2A:
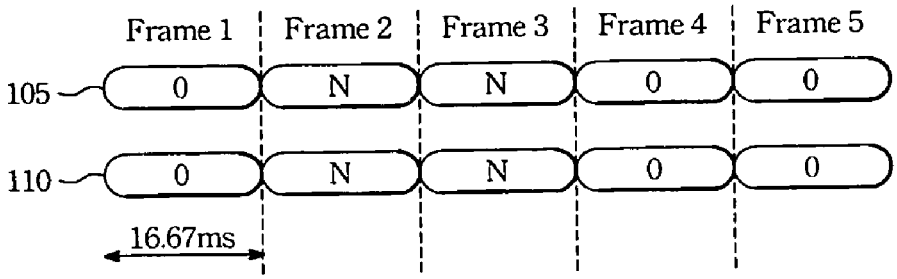
FIG. 2A (Prior Art)
FIGS. 2A and 2B showing a technique of over-voltage compensation fails because a gray level of the current frame differs from the previous frame but the gray level of the current frame is at totally black or white.
Figure 2B:
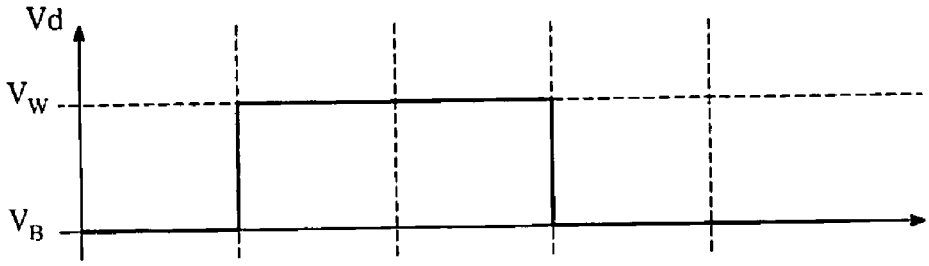
FIG. 2B (Prior Art)
Figure 3:
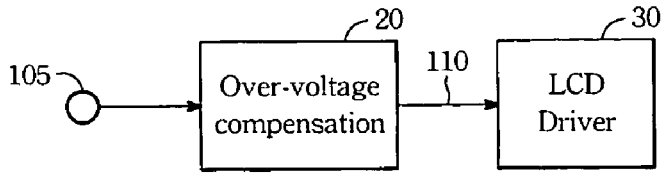
FIG. 3 (Prior Art)
FIG. 3 shows hardware of function blocks of over-voltage compensation in accordance with prior art.
Figure 4:
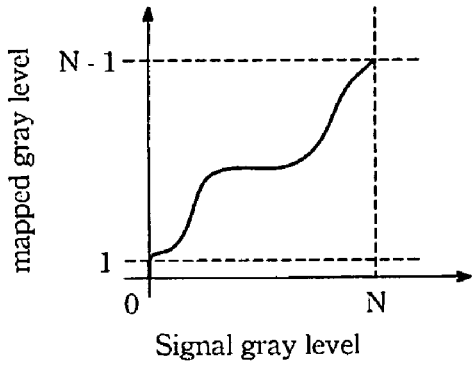
FIG. 4 shows a relationship between mapped gray levels and signal gray levels for usage in over-voltage compensation in accordance with the present invention.

A gray level mapping table is established firstly according to FIG. 4 that depicts the relationships between the signal gray level and mapped gray level. The signal gray level is the signal received from the signal input terminal of the LCD. According to a preferred embodiment of the present invention, the gray levels are from 0 to N and thus N+1 in total. The N+1 signal gray levels are then remapped into gray levels of I to N−I, wherein said N and I are natural number and I is significantly small than N. and the gray level N represents totally white, 0 represents totally black, In case gray levels represents by 8 bit code, the N is thus 255, and I is, for example, chosen from 1, 2 and 3. For illustrating convenience, I=1 is used to the following embodiment.

Since in total N+1 signal gray levels are remapped to N−1 mapped gray levels, at least four original signal gray levels will be remapped to two remapped gray levels. Preferably, we can make those neighboring gray levels with least resolution or less distinction by eyes maps to the same gray level. Alternatively, the N−1 numbers of signal gray levels mapped to a circuit which uses more bits than the original. For example, 8 bits for original sign 255 gray levels is ascended to 10 bits and then average out. That is performing a dithering process which utilizes less numbers of bits to simulate higher bits data. Though the dithering process need more memory cells to process data but it can improve the picture quality.

Following illustration is intended to depict embodiments of N+1 signal gray levels mapping to N−1 mapped gray levels.

After generating the gray level mapping table, the steps are: step 1: find out the corresponding mapped gray level of signal gray level according to the gray level mapping table of the present invention. FIG. 4 shows an example of gray level mapping table. In step 2, comparing the mapped gray level of the current frame to that of previous frame. While the results showing a variation occurs, the over-voltage compensate circuit is turn on to perform compensation. Otherwise, the over-voltage compensating circuit is turn off. According to the present invention, a positive compensation is done while the mapped gray level of the current frame is higher than the previous frame and a negative compensation is done while the mapped gray level of the current frame is lower than the previous frame.

Figure 5A:
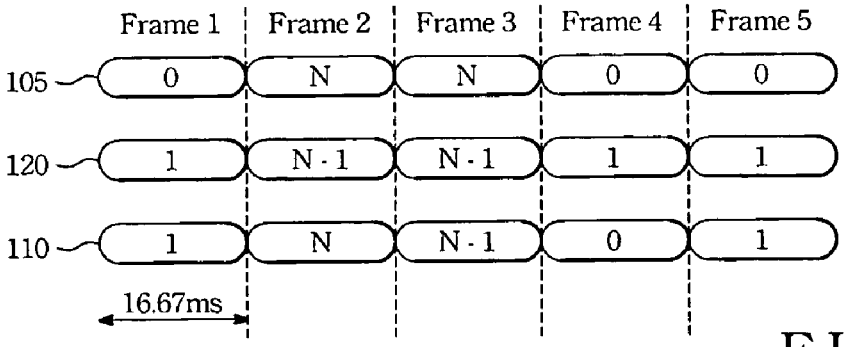
FIGS. 5A and 5B show a technique of over-voltage compensation in accordance with the present invention.

Please refer to FIG. 5A, assuming a signal gray level of a pixel inputting sequence 105 from the frame 1 to frame 5 are 0, N, N, 0, 0, the mapped gray level will be 1, N−1, N−1, 1, 1. After over-voltage compensation, the compensated gray lever will become 1, N, N−1, 0, 1 in accordance the forgoing step 2 of the present invention.

Figure 5B:
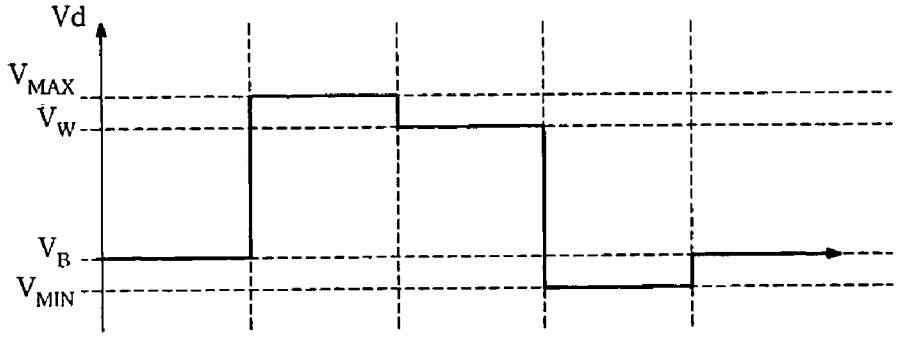

Thereafter, the compensated gray lever 1, N, N−1, 0, 1 are projected to voltages VB, VMAX, VW, VMIN, VB, represent, respectively, voltages of totally black, maximum, totally white, minimum, and totally black, as is shown in FIG. 5B. The Vd shown in FIG. 5B represents the voltage of data line of LCD.

Figure 6:
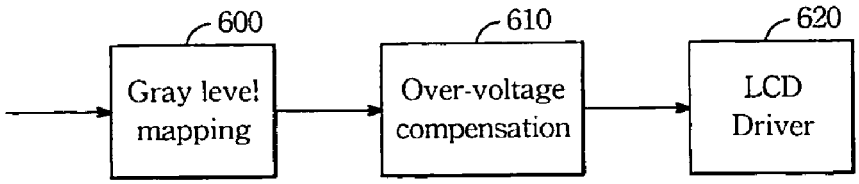
FIG. 6 shows hardware of function blocks of over-voltage compensation in accordance with the first preferred embodiment of the present invention.

To approach above results, the hardware function block according to the first preferred embodiment is shown in FIG. 6. First, the signal 105 is fed into the mapped circuit 600 and processed to generate the corresponding mapped gray level. Afterward, the mapped gray level is then proceeded by the over-voltage compensating circuit 610 to process the compensation if necessary. Thereafter, the resulted signal is then fed into data line 620 of LCD.

Figure 7:
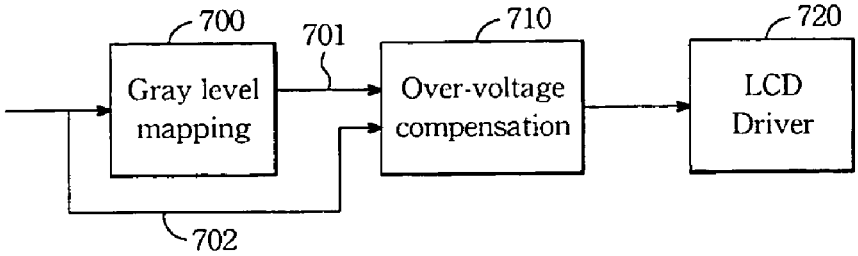
FIG. 7 shows hardware of function blocks of over-voltage compensation in accordance with the second preferred embodiment of the present invention.

Alternatively, referring to FIG. 7, the signal 105 is fed though the path 701 into the mapped circuit 700 and then processes by the over-voltage compensating circuit 710. Simultaneously, the signal 105 is through the path 702 into the over-voltage compensating circuit 710. The over-voltage compensating circuit 710 compares the gray level variation of the previous frame and current frame thereto determine if any necessary of the over-voltage compensation. After compensating or without compensating, the output signal of over-voltage compensating circuit 710 is then fed into data line 720 of LCD. The benefit of the present embodiment is to speed the compared process during the over-voltage compensating circuit 710. Since the data can be compared without waiting the data outputted from the mapped circuit 700 as previous embodiment the mapped circuit 700.

Figure 8A:
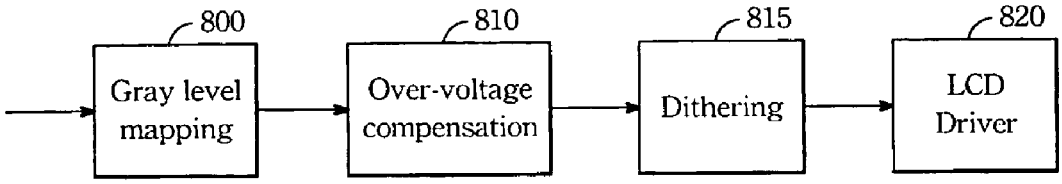
FIG. 8A shows hardware of function blocks of over-voltage compensation in accordance with the third preferred embodiment of the present invention.

Since the total numbers of signal gray levels are less than the mapped gray levels, the resolution is thus anticipated decrease. Thus, according to the third of preferred embodiment, a dithering circuit 815 is used to increase the resolution. Referring to FIG. 8A, the signal 105 is fed into the mapped circuit 800 and then processed to generate the corresponding mapped gray level. Afterward, the mapped gray level is then proceeded by the over-voltage compensating circuit 810 to process the compensation if necessary. Thereafter, the compensated signal is processed by dithering circuit 815. Finally, the resulting signal is fed into data line 820 of LCD. The dithering circuit provides a signal processing which utilizes the principle of human's eyes will averages out dense pixels that approximate a color from a mixture of other colors when the required color is not available so as to increase the resolution. In other words, the dithering circuit is to simulate those signals of low resolution to a higher resolution.

Figure 8B:
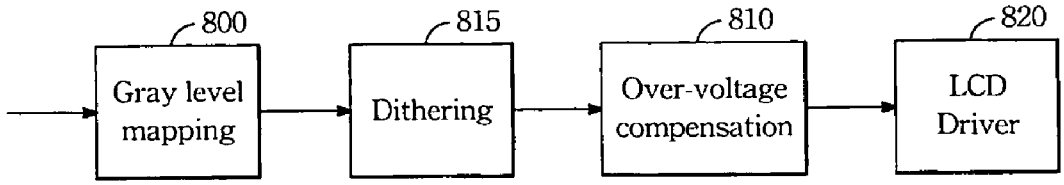
FIG. 8B shows hardware of function blocks of over-voltage compensation in accordance with the forth preferred embodiment of the present invention.

Alternatively, the dithering circuit 815 may intervene between the mapped circuit and over voltage circuit 810, as is shown in FIG. 8*b*.

As is understood by a person skilled in the art, the foregoing preferred embodiment of the present invention is an illustration of the present invention rather than limiting thereon. It is intended to cover various modifications and similar arrangements included within the spirit and scope of the appended claims, the scope of which should be accorded the broadest interpretation so as to encompass all such modifications and similar structure.

What is claimed is:

1. A method of dynamic frame improvement for a pixel on LCD, said method comprising the steps of:

providing a gray level mapping table having conversion relationships between gray levels of receiving signals and mapped gray levels, wherein said gray level mapping table having mapped gray levels from I to N−I gray levels for gray levels of receiving signals from 0 to N, where I is a number selected from a group consisting of 1, 2, and 3, and N is 255 for grey levels resolved by 8 bits;

receiving a plurality of signals and then generating mapped gray levels of said signals, respectively, according to said gray level mapping table; and proceeding over-voltage compensation for a pixel while the mapped gray level on said pixel of a current frame is different from the mapped gray level on said pixel of a previous frame.

2. The method according to claim 1, wherein said step proceeding over-voltage compensation is carried out a positive compensation while the mapped gray level on said pixel of a current frame is higher than the mapped gray level on said pixel of a previous frame and a negative compensation while the mapped gray level on said pixel of a current frame is lower than the mapped gray level on said pixel of a previous frame, and then outputs an compensated voltage for said pixel according to the resulted gray level.

3. The method according to claim 1, after said step of generating mapped gray levels of said signals and before said step of proceeding over-voltage compensation furthering comprises a dithering circuit to process said mapped signals so as to enhance resolution of said pixel.

4. The method according to claim 1, after said step of proceeding over-voltage compensation furthering comprises a dithering circuit to process said compensated signals so as to enhance resolution of said pixel.

5. Apparatus of liquid crystal display to improve dynamic frame, said apparatus comprising:

a gray level mapping circuit having a gray level mapping table coupled with a signal inputting terminal to generate mapped gray levels according to receiving signals and conversion relationship depicted in said gray level mapping table, wherein said gray level mapping table having mapped gray levels from I to N−I gray levels for gray levels of receiving signals from 0 to N, where I is a number selected from a group consisting of 1, 2, and 3, and N is 255 for grey levels resolved by 8 bits;

an over-voltage compensating circuit coupled with an outputting terminal of said gray level mapping circuit to compensate inputted signals if an occurrence of a variation of mapped gray level of a pixel on a current frame compared to said pixel of a previous frame.

6. The apparatus according to claim 5, wherein said over-voltage compensating circuit provides positive compensation if said variation is a natural number, no compensation if said variation is equal to 0, and negative compensation if said variation is a negative integral.

7. The apparatus according to claim 5, further comprises a dithering circuit placed in between said a gray level mapping circuit and said over-voltage compensating circuit.

8. The apparatus according to claim 5, further comprises a dithering circuit coupled with an outputting terminal of said over-voltage compensating circuit.

9. A method of dynamic frame improvement for a pixel on LCD, said method comprising the steps of:

providing a gray level mapping table having conversion relationships between gray levels of receiving signals and mapped gray levels, wherein said gray level mapping table having mapped gray levels from I to N−I gray levels for gray levels of receiving signals from 0 to N, where I is a number selected from the group consisting of 1, 2, and 3, and N is 255 for grey levels resolved by 8 bits;

receiving a plurality of signals and then generating mapped gray levels of said signals, respectively, according to said gray level mapping table; and proceeding a positive over-voltage compensation for a pixel while the mapped gray level on said pixel of a current frame is higher than the mapped gray level on said pixel of a previous frame and a negative over-voltage compensation while the mapped gray level on said pixel of a current frame is lower than the mapped gray level on said pixel of a previous frame, and then outputs an compensated voltage for said pixel according to the resulted gray level.

* * * * *